US007127838B2

(12) United States Patent
Menze

(10) Patent No.: US 7,127,838 B2
(45) Date of Patent: Oct. 31, 2006

(54) UNIVERSAL CONTROL ADAPTER SYSTEM

(75) Inventor: Peter C. Menze, Marquette, MI (US)

(73) Assignee: Ludington Technologies, Inc., Escanaba, MI (US)

( * ) Notice: Subject to any disclaimer, the term of this patent is extended or adjusted under 35 U.S.C. 154(b) by 0 days.

(21) Appl. No.: 11/227,928

(22) Filed: Sep. 15, 2005

(65) Prior Publication Data

US 2006/0070263 A1 Apr. 6, 2006

Related U.S. Application Data

(60) Provisional application No. 60/609,976, filed on Sep. 15, 2004.

(51) Int. Cl.

| | |
|---|---|
| ***E01C 19/22*** | (2006.01) |
| ***E01H 4/00*** | (2006.01) |
| ***E01H 5/00*** | (2006.01) |
| ***E02F 1/00*** | (2006.01) |
| ***E02F 3/00*** | (2006.01) |

(52) U.S. Cl. ..... 37/196; 37/195; 37/466

(58) Field of Classification Search ..... 37/231, 37/196, 266, 272, 195, 466, 903

See application file for complete search history.

(56) References Cited

U.S. PATENT DOCUMENTS

| | | | | |
|---|---|---|---|---|
| 3,944,316 | A * | 3/1976 | Newman et al. | 439/181 |
| 5,860,230 | A * | 1/1999 | Daniels | 37/232 |
| 6,075,333 | A * | 6/2000 | Huddle | 318/468 |
| 6,108,946 | A * | 8/2000 | Christy | 37/272 |
| 6,396,210 | B1 * | 5/2002 | Menze | 315/82 |
| 2002/0133981 | A1 * | 9/2002 | Menze | 37/266 |
| 2004/0027341 | A1 * | 2/2004 | Derocher | 345/173 |

* cited by examiner

*Primary Examiner*—Christopher J. Novosad
(74) *Attorney, Agent, or Firm*—Oppenheimer Wolff & Donnelly LLP

(57) ABSTRACT

A universal control adapter system allows any commercial or custom snowplow controller to be quickly and easily attached and detached from any commercial or custom snowplow blade. A first adapter connects the snowplow driver's controller to a first universal controller. A second adapter connects the snowplow to a second universal connector, where the second universal connector is configured to removably mate with the first universal connector. The first universal connector and second universal connector are color coded or otherwise configured to ensure proper mating. In this manner, skilled snowplow drivers can quickly and easily transfer their controllers to different vehicles rather than learning different controls for various snowplow manufacturers.

27 Claims, 11 Drawing Sheets

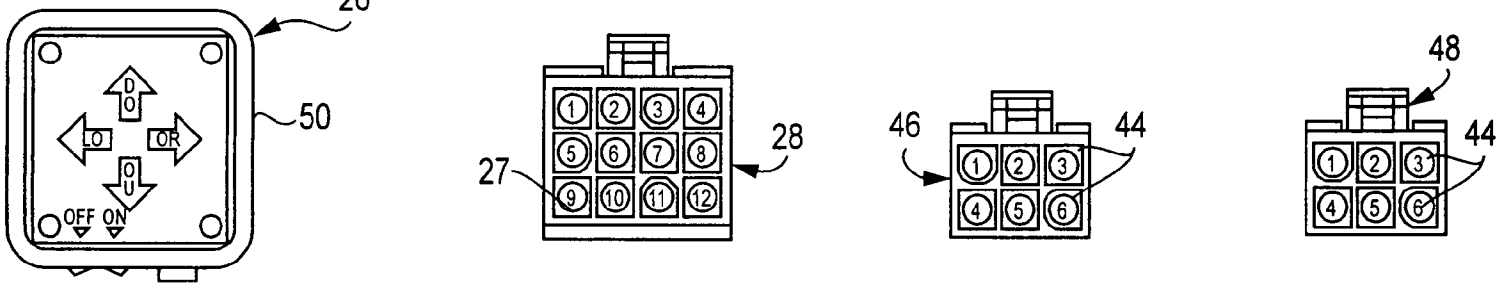
FIG. 2A
FIG. 2B
FIG. 2C
FIG. 2D
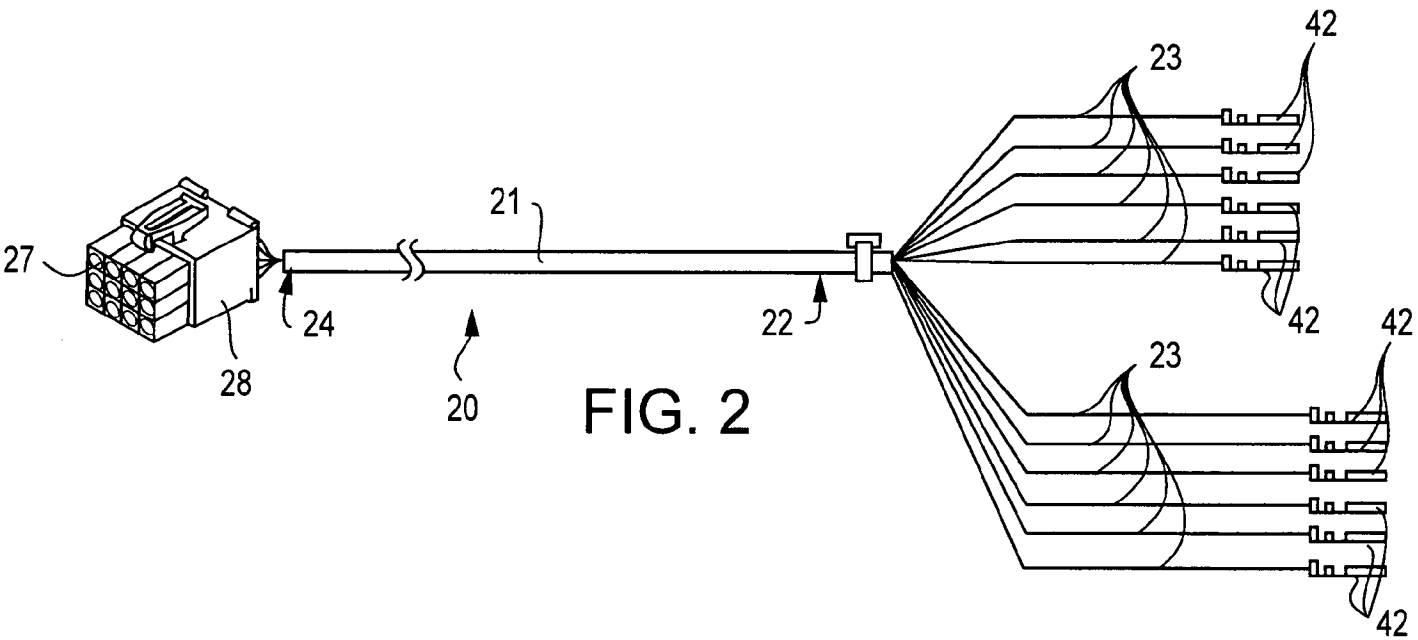
FIG. 2

UNIVERSAL CONTROL ADAPTER SYSTEM

RELATED APPLICATIONS

This application claims the benefit of U.S. Provisional Application No. 60/609,976 filed on Sep. 15, 2004.

BACKGROUND

The present invention pertains to snowplow systems designed for attachment to the front of a vehicle such as a pickup truck. These snowplow systems include a wiring harness that is routed to the interior cabin of the vehicle for connection to a control box. Typically, this wiring harness includes one or more connectors such that the control box may be disconnected from the plow. Some of the snowplow systems include a control box. Others require the purchase of an after-market control box. Further, some manufacturers of control boxes also manufacture compatible plow systems, while others simply manufacture control boxes.

Operating a plow while also operating a vehicle is a skill that is honed with experience. Understandably, some plow operators become extremely proficient using a particular control box and prefer not to change to a different control box. However, compatibility issues between control boxes and snowplows often require these operators to learn to use different control boxes, or forego work with a particular brand of plow.

There is a need for a system that resolves these compatibility issues, thereby allowing a plow operator to attach a favorite control box to any make of snowplow. Preferably, the system allows the connection between the control box and the snowplow to be made without requiring wire splicing.

BRIEF SUMMARY OF THE INVENTION

The present invention addresses the above-mentioned need by providing an adapter system that allows a plow operator to attach any control box to any make of snowplow. The system generally includes a first adapter and a second adapter. The first adapter has a length of straight cord having a first end and a second end. The first end has a plurality of pins for removably connecting the first end to a connector compatible with a controller box. The second end is removably connected to a universal connector that is configured to mate with another universal connector.

Similarly, the second adapter has a length of tubing having a first end and a second end. The first end is removably attached to another universal connector that is configured to mate with another universal connector. The second end is removably attached to a connector configured to mate with a snowplow.

Thus, connecting a controller box made by Brand A with a snowplow made by Brand B is simply a matter of attaching a Brand A first adapter to the controller box, and a Brand B second adapter to the snowplow. The universal connector ends of the first and second adapters can then be connected together to establish connectivity between the control box and the snowplow.

BRIEF DESCRIPTION OF THE DRAWINGS

FIG. 2 is a schematic of an embodiment of a first adapter of the present invention.

FIG. 2A is a schematic of a vee-blade touchpad harness used with the first adapter of the present invention.

FIG. 2B is a front plan view of a universal connector positioned at a second end of the first adapter of the present invention.

FIG. 2C is a front plan view of a first connector positioned at a first end of the first adapter of the present invention.

FIG. 2D is a front plan view of a second connector positioned at a first end of the first adapter of the present invention.

DETAILED DESCRIPTION OF THE INVENTION

Figure 11:
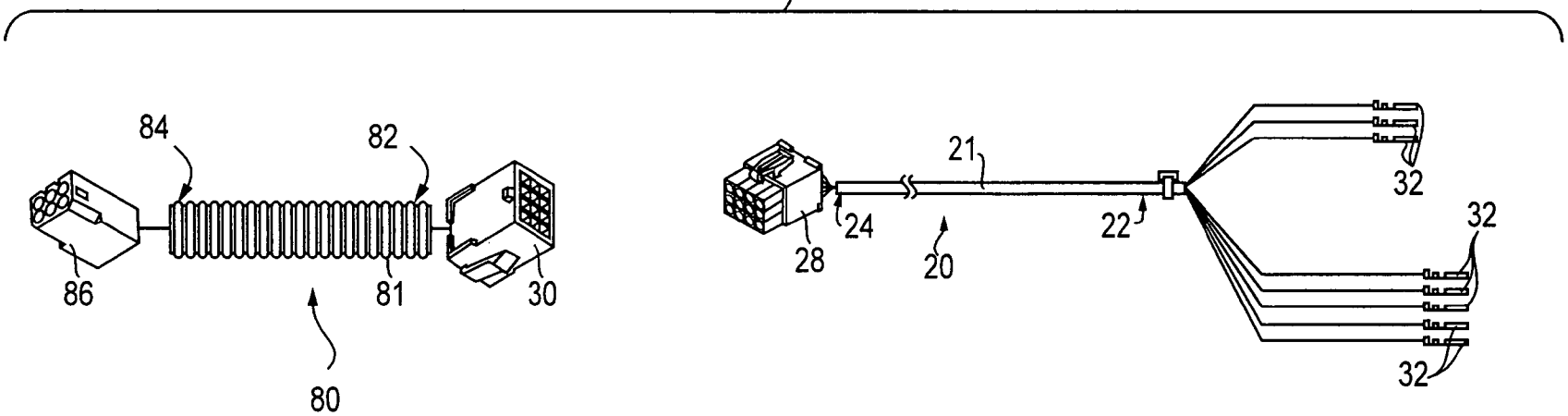
FIG. 11 is a schematic of one embodiment of the universal control adapter system of the present invention.

Referring to FIG. 11, there is shown a general schematic overview of one embodiment of a universal control adapter system 8 of the present invention. Specifically, there is shown a first adapter 20 connected to a second adapter 80 by way of mating universal connectors 28 and 30. While FIG. 11 depicts a first end 22 on the first adapter 20 having a plurality of pins 32 and a second adapter 80 having a second end 84 with a connector 86 configured to mate with a connector of a particular snowplow, various other embodiments are within the scope of the present invention. Following there are several embodiments of the first and second adapters 20 and 80, respectively.

Referring now to the Figures, and first to FIGS. 1 through 5, there are shown various embodiments of a first adapter 20 of the present invention. Each of the first adapters 20 includes a length of straight cord 21 having a first end 22 and a second end 24. The first ends 22 are constructed and arranged for attachment to particular controller boxes 26. The second ends 24 include a universal connector 28 configured to mate with a universal connector 30 (FIGS. 6–10).

Figure 1D:
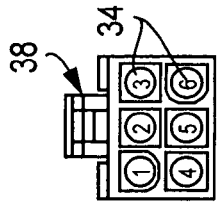
FIG. 1D is a front plan view of a second connector positioned at a first end of the first adapter of the present invention.
Figure 1C:
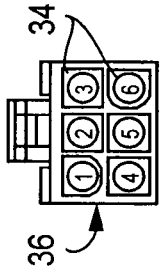
FIG. 1C is a front plan view of a first connector positioned at a first end of the first adapter of the present invention.
Figure 1B:
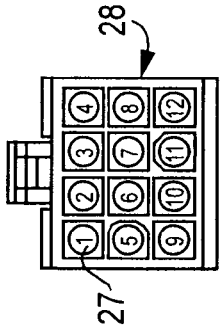
FIG. 1B is a front plan view of a universal connector positioned at a second end of the first adapter of the present invention.
Figure 1A:
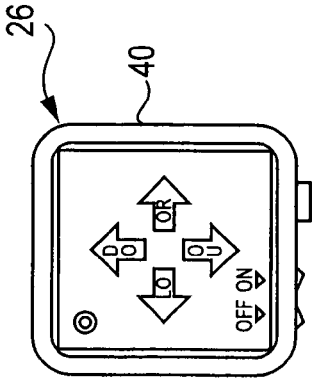
FIG. 1A is a top plan view of a straight blade touchpad harness used with the first adapter of the present invention.
Figure 1:
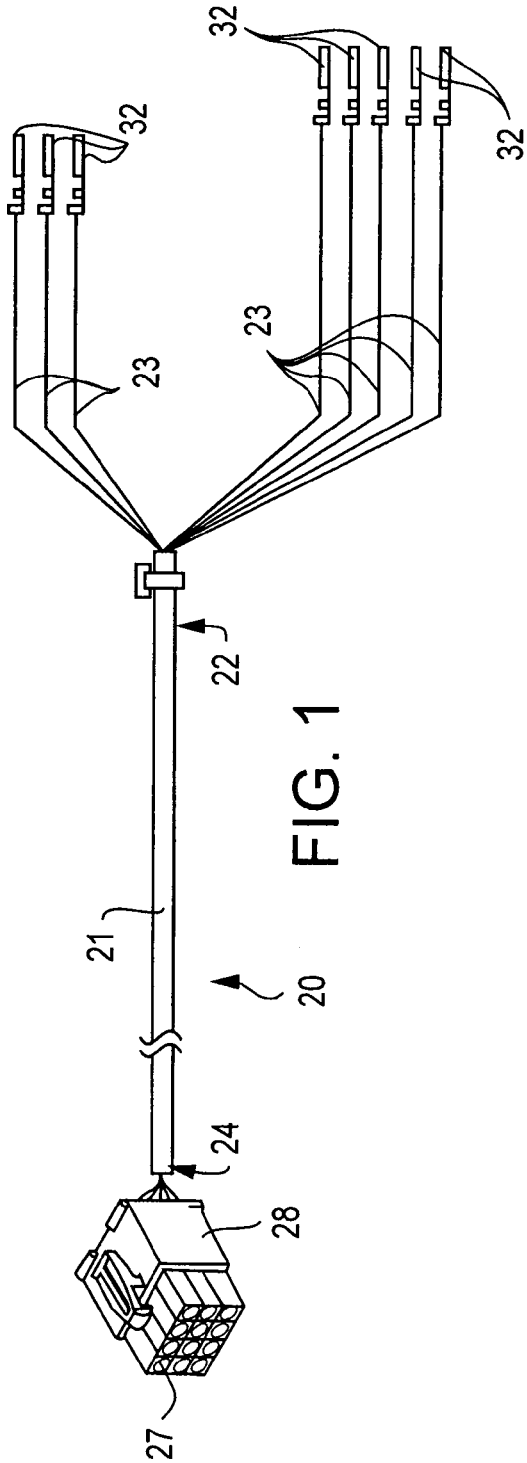
FIG. 1 is a schematic of an embodiment of a first adapter of the present invention.

For example, FIG. 1 shows a first adapter 20 having a straight cord 21 with a first end 22 and a second end 24. The first end 22 has a plurality of pins 32, which are insertable into the female receptacles 34 of connectors 36 and 38 sold under the trademark TYCO® (Tyco International Services AG Corporation, Switzerland), which are connected to a straight blade touchpad harness 40 , as depicted in FIG. 1A. The second end 24 connects to a universal connector 28. Tables 1 and 2 show the functions of the individual pins 32 as they relate to pin 32 numbers depicted in FIGS. 1C and 1D. Table 3 shows the functions of the pins 27 of the universal connector 28. Referring to FIG. 1B, in one embodiment, individual wires 23 bundled within the straight cord 21 are color coded to correspond to color coded receptacles 34 in connectors 36 and 38 and to the pins 27 of the universal connector 28.

TABLE 1

| TYCO ® CONNECTOR P/N 172170-1<br>TYCO ® TERMINALS P/N 770804-1 | | | |
|---|---|---|---|
| PIN # | COLOR | FUNCTION | AWG |
| 1 | RED | POS {+} | 18 |
| 2 | WHITE | RAISE | 20 |
| 3 | ORANGE | FLOAT | 18 |
| 4 | BROWN | PUMP SOLENOID | 18 |
| 5 | GREEN | RIGHT | 20 |
| 6 | BLUE | LEFT | 20 |

TABLE 1-continued

| TYCO ® CONNECTOR P/N 172170-1<br>TYCO ® TERMINALS P/N 770804-1 | | | |
|---|---|---|---|
| PIN # | COLOR | FUNCTION | AWG |
| 7 | N/A | N/A | |
| 8 | N/A | N/A | |
| 9 | PINK/BLACK | AUXILIARY | 20 |
| 10 | N/A | N/A | |
| 11 | N/A | N/A | |
| 12 | BLACK | GROUND | 20 |

TABLE 2

| TYCO ® CONNECTOR P/N 172168-1<br>TYCO ® TERMINALS P/N 770904-1 | | |
|---|---|---|
| PIN # | COLOR | FUNCTION |
| 1 | N/A | N/A |
| 2 | N/A | N/A |
| 3 | BLACK | GROUND {−} |
| 4 | WHITE | LIFT |
| 5 | N/A | N/A |
| 6 | ORANGE | DOWN |

TABLE 3

| TYCO ® CONNECTOR P/N 172168-1<br>TYCO ® TERMINALS P/N 770904-1 | | |
|---|---|---|
| PIN # | COLOR | FUNCTION |
| 1 | RED | POS {+} |
| 2 | N/A | N/A |
| 3 | PINK/BLACK | AUXILIARY |
| 4 | BLUE | LEFT |
| 5 | GREEN | RIGHT |
| 6 | BROWN | PUMP SOLENOID |

FIG. 2 shows a first adapter 20 having a straight cord 21 with a first end 22 and a second 24. The first end 22 that has a plurality of pins 42 , which are insertable into the female receptacles 44 of connectors 46 and 48 sold under the trademark TYCO® (Tyco International Services AG Corporation, Switzerland), which are connected to a vee-blade touchpad harness 50. The second end connects to a universal connector 28. Tables 4 and 5 show the functions of the individual pins 42 depicted in FIGS. 2C and 2D. Table 6 shows the functions of the pins 27 of the universal connector 28. Referring to FIG. 2B, in one embodiment, individual wires 23 bundled within the straight cord 21 are color coded to correspond to color coded receptacles 44 in connectors 46 and 48 and to the pins 27 of the connector 28.

TABLE 4

| TYCO ® CONNECTOR P/N 172170-1<br>TYCO ® TERMINALS P/N 770904-1 | | | |
|---|---|---|---|
| PIN # | COLOR | FUNCTION | AWG |
| 1 | RED | POS {+} | 18 |
| 2 | WHITE | RAISE | 20 |
| 3 | ORANGE | FLOAT | 18 |
| 4 | BROWN | PUMP SOLENOID | 18 |
| 5 | GREEN | RIGHT | 20 |
| 6 | BLUE | LEFT | 20 |
| 7 | RED/WHITE | RIGHT WING OUT | 20 |

TABLE 4-continued

| TYCO ® CONNECTOR P/N 172170-1 TYCO ® TERMINALS P/N 770904-1 | | | |
|---|---|---|---|
| PIN # | COLOR | FUNCTION | AWG |
| 8 | RED/BLACK | RIGHT WING IN | 20 |
| 9 | PINK/BLACK | AUXILIARY | 20 |
| 10 | BLUE/WHITE | LEFT WING OUT | 20 |
| 11 | BLUE/BLACK | LEFT WING IN | 20 |
| 12 | BLACK | GROUND | 20 |

TABLE 5

| TYCO ® CONNECTOR P/N 172168-1 TYCO ® TERMINALS P/N 770904-1 | | |
|---|---|---|
| PIN # | COLOR | FUNCTION |
| 1 | RED/BLACK | RIGHT WING IN |
| 2 | BLUE/WHITE | LEFT WING OUT |
| 3 | BLACK | GROUND {−} |
| 4 | WHITE | LIFT |
| 5 | RED/WHITE | RIGHT WING OUT |
| 6 | ORANGE | DOWN |

TABLE 6

| TYCO ® CONNECTOR P/N 172168-1 TYCO ® TERMINALS P/N 770904-1 | | |
|---|---|---|
| PIN # | COLOR | FUNCTION |
| 1 | RED | POS {+} |
| 2 | BLUE/BLACK | LEFT WING IN |
| 3 | PINK/BLACK | AUXILIARY |
| 4 | BLUE | LEFT |
| 5 | GREEN | RIGHT |
| 6 | BROWN | PUMP SOLENOID |

Figure 3A:
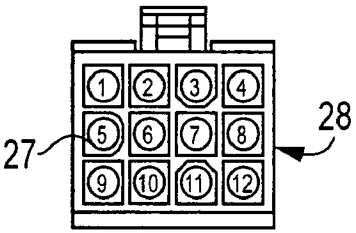
FIG. 3A is a front plan view of a universal connector positioned on the second end of the first adapter of the present invention.
Figure 3:
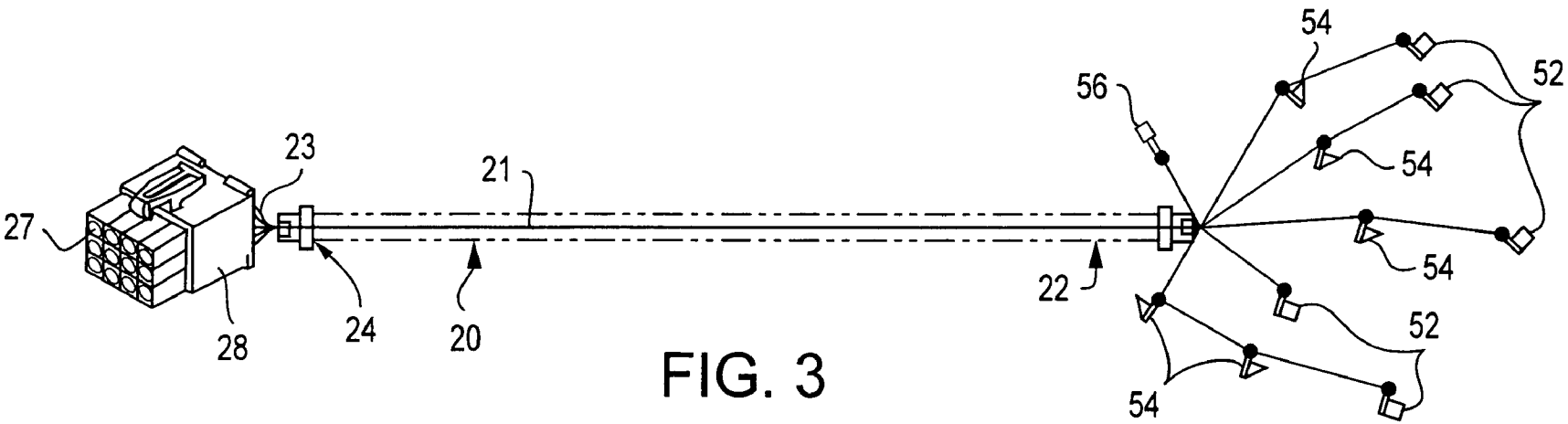
FIG. 3 is a schematic of an embodiment of a first adapter of the present invention.

FIG. 3 shows a first adapter 20 having a straight cord 21 with a first end 22 and a second end 24. The first end 22 has a plurality of flag terminals 52 and 54, and a female coupler 56. The terminals 52 and 54 , as well as female coupler 56, connect to a main large joystick harness (not shown). The second end connects to a universal connector 28. Table 7 shows the functions of the pins 27 of the universal connector 28. In one embodiment, individual wires 23 bundled within the straight cord 21 are color coded to correspond to particular pins 27 of the universal connector 28 as depicted in FIG. 3A.

TABLE 7

| TYCO ® CONNECTOR P/N 172170-1 TYCO ® TERMINALS P/N 770904-1 | | |
|---|---|---|
| PIN # | COLOR | FUNCTION |
| 1 | RED | POS {+} |
| 2 | WHITE | RAISE |
| 3 | ORANGE | FLOAT |
| 4 | BROWN | PUMP SOLENOID |
| 5 | GREEN | RIGHT |
| 6 | BLUE | LEFT |
| 7 | N/A | N/A |
| 8 | N/A | N/A |
| 9 | N/A | N/A |
| 10 | N/A | N/A |
| 11 | N/A | N/A |
| 12 | N/A | N/A |

Figure 4C:
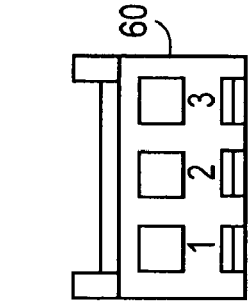
FIG. 4C is a front plan view of receptacles in a connector of an up/down joystick harness.
Figure 4B:
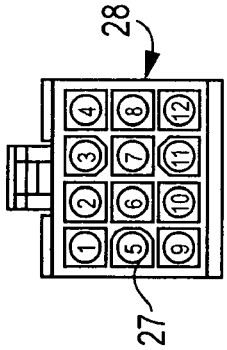
FIG. 4B is a front plan view of a universal connector positioned on the second end of the first adapter of the present invention.
Figure 4A:
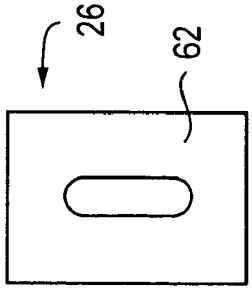
FIG. 4A is a top plan view of an up/down small joystick harness used with the first adapter of the present invention.
Figure 4:
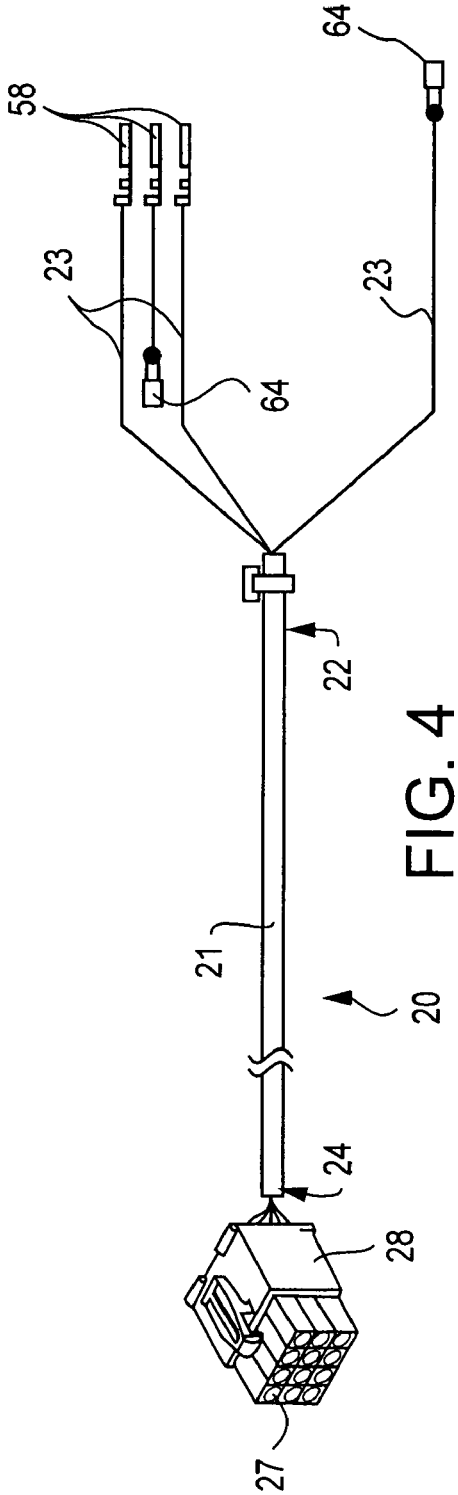
FIG. 4 is a schematic of an embodiment of a first adapter of the present invention.

FIG. 4 shows a first adapter 20 having a straight cord 21 with a first end 22 and a second end 24. The first end 22 has a plurality of pins 58 that are connectable to a connector 60 of an up/down small joystick harness 62. The up/down small joystick harness 62 is depicted in FIG. 4A. There are also female couplers 64 connectable to a 12V power supply (not shown). Tables 8 and 9 show the functions of the pins of universal connector 28 and of the pins 58, respectively. In one embodiment, individual wires 23 bundled within the straight cord 21 are color coded to correspond to receptacles in a connector 60 (shown in FIG. 4C) of an up/down joystick harness 62 and to the pins 27 of the universal connector 28. FIG. 4B depicts a numbering configuration for the pins 27 of the universal connector 28 in order to mate the universal connector 28 with other connectors based on function.

TABLE 8

| TYCO ® CONNECTOR P/N 172170-1 TYCO ® TERMINALS P/N 770904-1 | | |
|---|---|---|
| PIN # | COLOR | FUNCTION |
| 1 | RED | POS {+} |
| 2 | N/A | N/A |
| 3 | ORANGE | FLOAT |
| 4 | BROWN | PUMP SOLENOID |
| 5 | N/A | N/A |
| 6 | N/A | N/A |
| 7 | N/A | N/A |
| 8 | N/A | N/A |
| 9 | N/A | N/A |
| 10 | N/A | N/A |
| 11 | N/A | N/A |
| 12 | N/A | N/A |

TABLE 9

| AMP SL-156 PRINTED CIRCUIT BOARD CONNECTOR WITH LOCKING RAMP/WITH POLARIZING TABS 0.465 (No. of Pos. 3) P/N 770849-3 WITH AMP SL-156 CRIMP CONTACTS CONTACT -C HOODED (DUAL WIPE) 10 AMP MAX. STRIP P/N 770476-1 LOOSE PIECE P/N 770522-1 | | |
|---|---|---|
| PIN # | COLOR | FUNCTION |
| 1 | BROWN | PUMP SOLENOID |
| 2 | RED | 12 v+ |
| 3 | ORANGE | FLOAT |

Figure 5D:
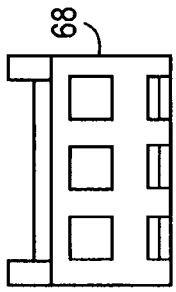
FIG. 5D is a front plan view of a second connector positioned at a first end of the first adapter of the present invention.
Figure 5C:
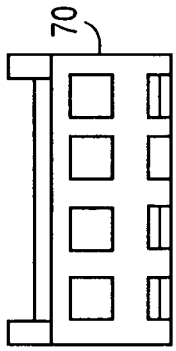
FIG. 5C is a front plan view of a first connector positioned at a first end of the first adapter of the present invention.
Figure 5B:
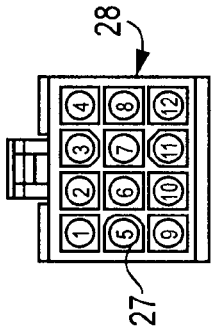
FIG. 5B is front plan view of a universal connector positioned on the second end of the first adapter of the present invention.
Figure 5A:
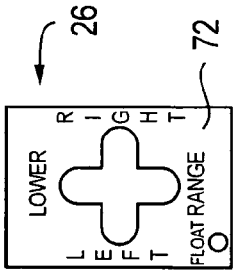
FIG. 5A is a top plan view of a 4-way small joystick harness used with the first adapter of the present invention.
Figure 5:
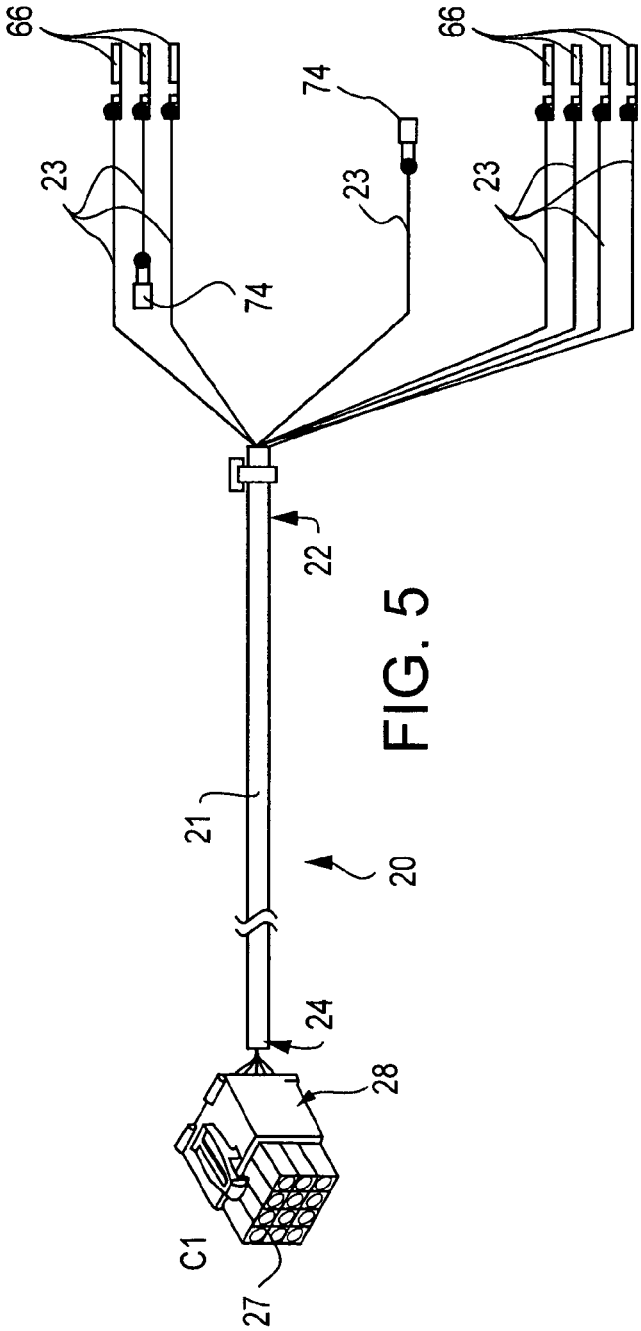
FIG. 5 is a schematic of an embodiment of a first adapter of the present invention.

FIG. 5 shows a first adapter 20 having a straight cord 21 with a first end 22 and a second end 24. The first end 22 has a plurality of pins 66 connectable to connectors 68 and 70 of a 4-way small joystick harness 72, as depicted in FIG. 5A. The functions of the pins 66 are shown in Tables 11 and 12. Additionally, female couplers 74 are connectable to a 12V power supply (not shown). Table 10 shows the functions of the pins of universal connector 28. In one embodiment, individual wires 23 bundled within the straight cord 21 are color coded to correspond to receptacles in connectors 68 and 70 of a 4-way small joystick harness 72 and to the pins 27 of the universal connector 28 (shown in FIGS. 5C and FIG. 5D). Referring to FIG. 5B, there is shown a numbering configuration for the pins 27 of the universal connector 28 in order to mate the universal connector 28 with other connectors based on function.

TABLE 10

| TYCO ® CONNECTOR P/N 172170-1 TYCO ® TERMINALS P/N 770904-1 | | |
|---|---|---|
| PIN # | COLOR | FUNCTION |
| 1 | RED | POS {+} |
| 2 | WHITE | RAISE |
| 3 | ORANGE | FLOAT |
| 4 | BROWN | PUMP SOLENOID |
| 5 | GREEN | RIGHT |
| 6 | BLUE | LEFT |
| 7 | N/A | N/A |
| 8 | N/A | N/A |
| 9 | N/A | N/A |
| 10 | N/A | N/A |
| 11 | N/A | N/A |
| 12 | BLACK | GROUND |

TABLE 11

| AMP SL-156 PRINTED CIRCUIT BOARD CONNECTOR WITH LOCKING RAMP/WITH POLARIZING TABS 0.465 (No. of Pos. 3) P/N 770849-3 WITH AMP SL-156 CRIMP CONTACTS CONTACT -C HOODED (DUAL WIPE) 10 AMP MAX. STRIP P/N 770476-1 LOOSE PIECE P/N 770522-1 | | |
|---|---|---|
| PIN # | COLOR | FUNCTION |
| 1 | BROWN | PUMP SOLENOID |
| 2 | RED | 12 v+ |
| 3 | ORANGE | FLOAT |

TABLE 12

| AMP SL-156 PRINTED CIRCUIT BOARD CONNECTOR WITH LOCKING RAMP/WITH POLARIZING TABS 0.465 (No. of Pos. 3) P/N 770849-3 WITH AMP SL-156 CRIMP CONTACTS CONTACT -C HOODED (DUAL WIPE) 10 AMP MAX. STRIP P/N 770476-1 LOOSE PIECE P/N 770522-1 | | |
|---|---|---|
| PIN # | COLOR | FUNCTION |
| 1 | BLUE | LEFT |
| 2 | GREEN | RIGHT |
| 3 | BLACK | GROUND |
| 4 | WHITE | RAISE |

FIGS. 6–10 show various embodiments of a second adapter 80 of the present invention, usable to connect a first adapter 20 to a particular snowplow. Each second adapter 80 has length of tubing 81 having a first end 82 and a second end 84. Each first end 82 includes a universal connector 30 configured to mate with the universal connectors 28 of the various embodiments of the first adapters 20. Thus, despite the various embodiments of the present invention, each of the universal connectors 28 of the various first adapters 20 is the same, as is each of the universal connectors 30 of the various second adapters 80. Each second end 84 of the second adapters 80 is constructed and arranged to be attached to a particular snowplow.

Figure 6B:
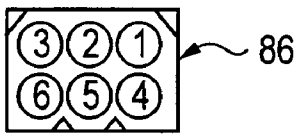
FIG. 6B is a front plan view of a connector configured to mate with a connector of a particular snowplow.
Figure 6:
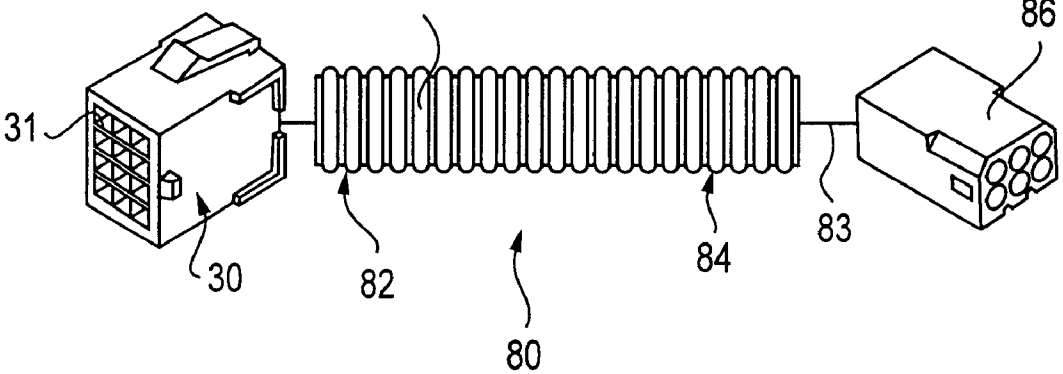
FIG. 6 is a schematic of an embodiment of a second adapter of the present invention.
Figure 6A:
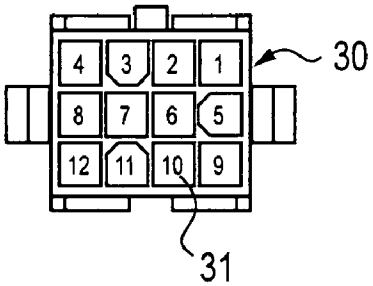
FIG. 6A is a front plan view of a universal connector positioned on the second end of the first adapter of the present invention.

For example, FIG. 6 shows a second adapter 80 with a first end 82 and a second end 84. The second end 84 has a connector 86 configured to mate with a connector of a snowplow sold under the trademarks of MEYER® or DIAMOND® (manufactured by Meyer Products, Inc., Cleveland, Ohio) (not shown). Referring to FIG. 6B, there is shown a numbering configuration for the connector 86. FIG. 6A depicts a numbering configuration for the pins 31 of the universal connector 30 in order to mate the universal connector 30 with other connectors based on function. The pin assignments of both connectors 30 and 86 are shown in Tables 13 and 14.

TABLE 13

| TYCO ® CONNECTOR P/N 172170-1 TYCO ® TERMINALS P/N 770904-1 | | |
|---|---|---|
| PIN # | COLOR | FUNCTION |
| 1 | RED | POS {+} |
| 2 | N/A | N/A |
| 3 | ORANGE | FLOAT |
| 4 | BROWN | PUMP SOLENOID |
| 5 | GREEN | RIGHT |
| 6 | BLUE | LEFT |
| 7 | N/A | N/A |
| 8 | N/A | N/A |
| 9 | N/A | N/A |
| 10 | N/A | N/A |
| 11 | N/A | N/A |
| 12 | BLACK | GROUND |

TABLE 14

| "AMP" 0.093 (6) PIN POWER CONNECTOR P/N 770086-1 WITH "AMP" FEMALE-TERMINAL P/N 770529-1 (F) | | |
|---|---|---|
| PIN # | COLOR | FUNCTION |
| 1 | BROWN | PUMP SOLENOID |
| 2 | RED | POS {+} |
| 3 | BLACK | GROUND |
| 4 | BLUE | LEFT |
| 5 | GREEN | RIGHT |
| 6 | ORANGE | FLOAT |

Figure 7B:
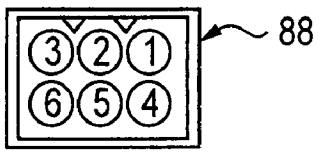
FIG. 7B is a front plan view of a connector configured to mate with a connector of a particular snowplow.
Figure 7:
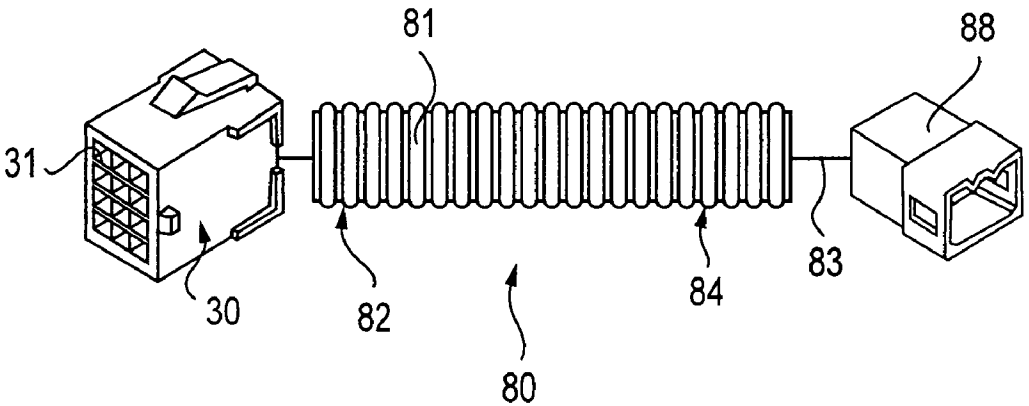
FIG. 7 is a schematic of an embodiment of a second adapter of the present invention.
Figure 7A:
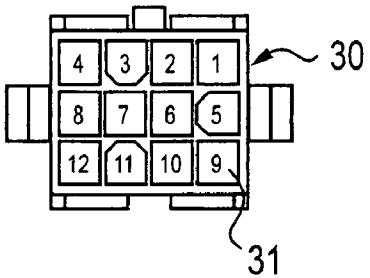
FIG. 7A is a front plan view of a universal connector positioned on the second end of the first adapter of the present invention.

FIG. 7 shows a second adapter 80 with a first end 82 and a second end 84. The second end 84 has a connector 88 configured to mate with a connector of a straight blade snowplow sold under the trademark WESTERN® (manufactured by Western Products, Miliwaukee, Wis.) (not shown) or the trademark FISHER® (manufactured by Fisher Engineering, Rockland, Me.) (not shown). FIG. 7B depicts a numbering configuration of the connector 88. The pin assignments of both connectors 30 and 88 are shown in Tables 15 and 16. In addition, FIG. 7A depicts a numbering configuration for the pins 31 of the universal connector 30 in order to mate the universal connector 30 with other connectors based on function.

TABLE 15

| TYCO ® CONNECTOR P/N 172162-1 TYCO ® TERMINALS P/N 770903-1 | | |
|---|---|---|
| PIN # | COLOR | FUNCTION |
| 1 | RED | POS {+} |
| 2 | WHITE | RAISE |
| 3 | ORANGE | FLOAT |
| 4 | BROWN | PUMP SOLENOID |
| 5 | GREEN | RIGHT |
| 6 | BLUE | LEFT |
| 7 | N/A | N/A |
| 8 | N/A | N/A |
| 9 | N/A | N/A |
| 10 | N/A | N/A |
| 11 | N/A | N/A |
| 12 | BLACK | GROUND |

TABLE 16

| "AMP" 0.062 (6) PIN POWER CONNECTOR P/N 770086-1 WITH "AMP" FEMALE-TERMINAL P/N 770355-1 WITH "AMP" FEMALE TERMINAL P/N 794017-1 (M) | | |
|---|---|---|
| PIN # | COLOR | FUNCTION |
| 1 | RED | POS {+} |
| 2 | GREEN | RIGHT |
| 3 | BLACK | GROUND |
| 4 | BROWN | PUMP SOLENOID |
| 5 | WHITE | RAISE |
| 6 | ORANGE | FLOAT |

Figure 8:
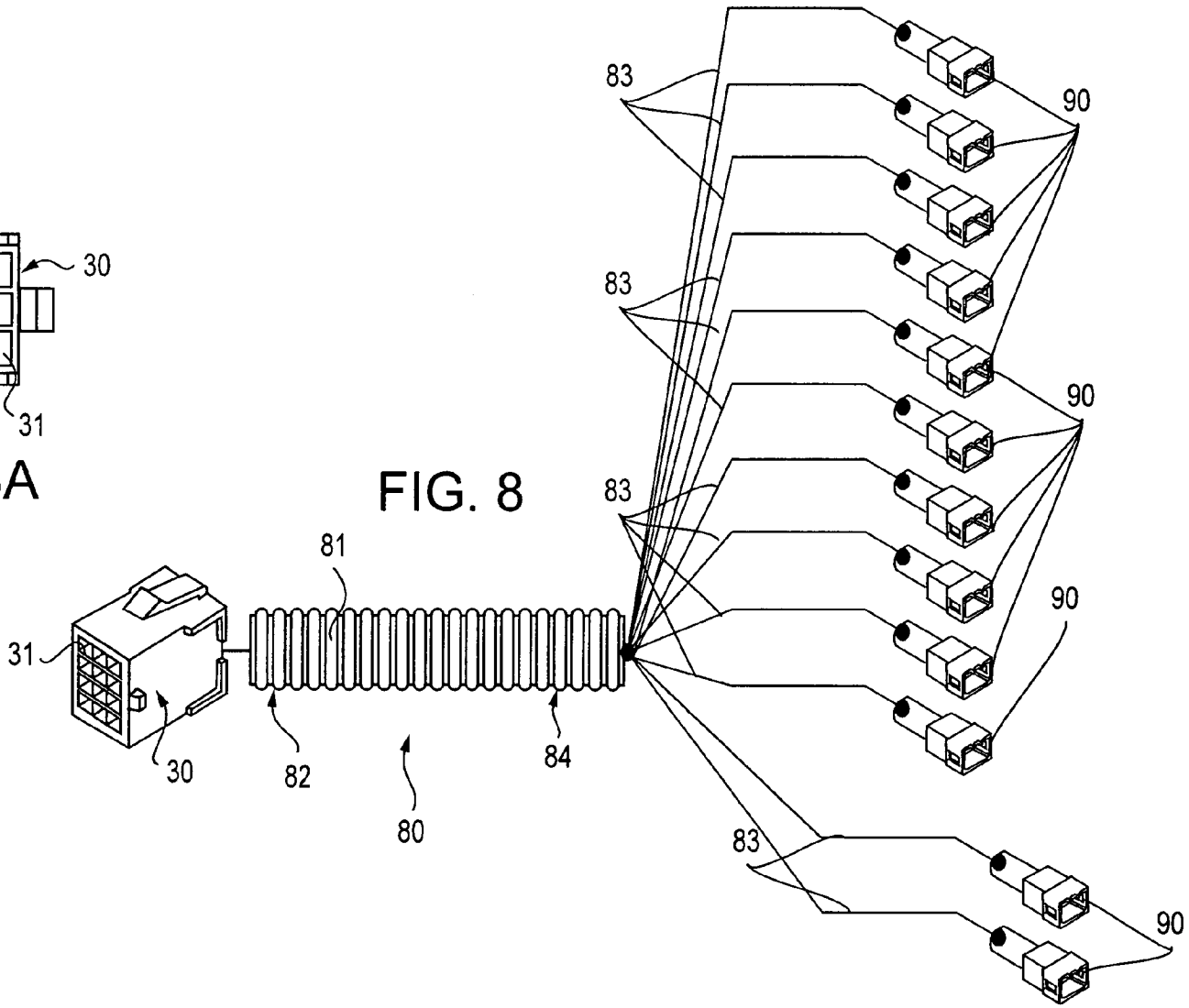
FIG. 8 is a schematic of an embodiment of a second adapter of the present invention.
Figure 8A:
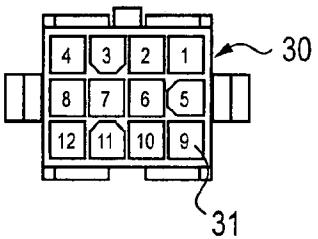
FIG. 8A is a front plan view of a universal connector positioned on the second end of the first adapter of the present invention.

FIG. 8 shows a second adapter 80 with a first end 82 and a second end 84. The second end 84 has several female terminals 90 configured to mate with male terminals of any snowplow that does not have a specific connector, but allows individual wire plugs. FIG. 8A depicts a numbering configuration for the pins 31 of the universal connector 30 in order to mate the universal connector 30 with other connectors based on function. The pin assignments of the connector 30 are shown in Table 17.

TABLE 17

| TYCO ® CONNECTOR P/N 172162-1 TYCO ® TERMINALS P/N 770903-1 | | |
|---|---|---|
| PIN # | COLOR | FUNCTION |
| 1 | RED | POS {+} |
| 2 | WHITE | RAISE |
| 3 | ORANGE | FLOAT |
| 4 | BROWN | PUMP SOLENOID |
| 5 | GREEN | RIGHT |
| 6 | BLUE | LEFT |
| 7 | RED/WHITE | RIGHT WING OUT |
| 8 | RED/BLACK | RIGHT WING IN |
| 9 | PINK/BLACK | AUXILIARY |
| 10 | BLUE/WHITE | LEFT WING OUT |
| 11 | BLUE/BLACK | LEFT WING IN |
| 12 | BLACK | GROUND |

Figure 9B:
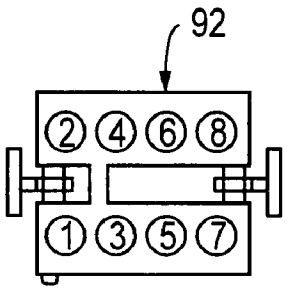
FIG. 9B is a front plan view of a connector configured to mate with a connector of a particular snowplow.
Figure 9A:
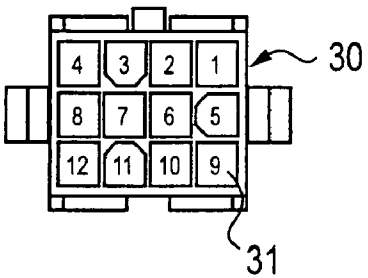
FIG. 9A is a front plan view of a universal connector positioned on the second end of the first adapter of the present invention.
Figure 9:
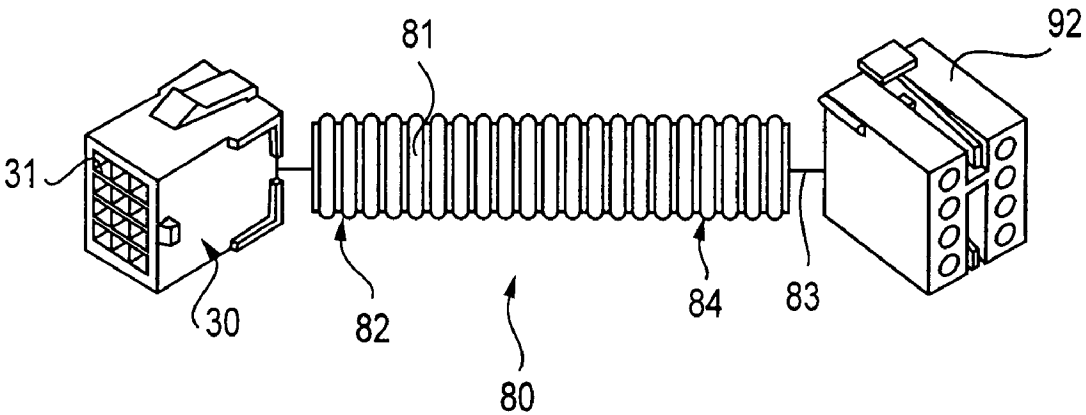
FIG. 9 is a schematic of an embodiment of a second adapter of the present invention.

FIG. 9 shows a second adapter 80 with a first end 82 and a second end 84. The second end 84 has a connector 92 configured to mate with a connector of a snowplow sold under the trademark NORTHMAN® (manufactured by Northman Snow Plows, Sioux Falls, S.Dak.) (not shown). FIG. 9B depicts a numbering configuration of the connector 92. FIG. 9A depicts a numbering configuration for the pins 31 of the universal connector 30 in order to mate the universal connector 30 with other connectors based on function. The pin assignments of both connectors 30 and 92 are shown in Tables 18 and 19.

TABLE 18

| TYCO ® CONNECTOR P/N 172162-1 TYCO ® TERMINALS P/N 770903-1 | | |
|---|---|---|
| PIN # | COLOR | FUNCTION |
| 1 | RED | POS {+} |
| 2 | WHITE | RAISE |
| 3 | ORANGE | FLOAT |
| 4 | BROWN | PUMP SOLENOID |
| 5 | GREEN | RIGHT |
| 6 | BLUE | LEFT |

TABLE 18-continued

| TYCO ® CONNECTOR P/N 172162-1 TYCO ® TERMINALS P/N 770903-1 | | |
|---|---|---|
| PIN # | COLOR | FUNCTION |
| 7 | N/A | N/A |
| 8 | N/A | N/A |
| 9 | N/A | N/A |
| 10 | N/A | N/A |
| 11 | N/A | N/A |
| 12 | BLACK | GROUND |

TABLE 19

| DIGI-KEY ® CONNECTOR P/N A1207-ND DIGI-KEY ® TERMINALS P/N A1423-ND | | |
|---|---|---|
| PIN # | COLOR | FUNCTION |
| 1 | BLACK | GROUND |
| 2 | N/A | N/A |
| 3 | RED | POS {+} |
| 4 | GREEN | RIGHT |
| 5 | ORANGE | FLOAT |
| 6 | BROWN | PUMP |
| 7 | BLUE | LEFT |
| 8 | N/A | N/A |

Figure 10B:
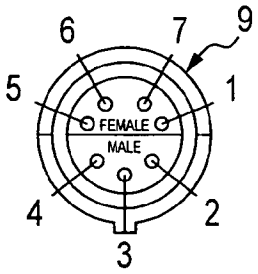
FIG. 10B is a front plan view of a connector configured to mate with a connector of a particular snowplow.
Figure 10A:
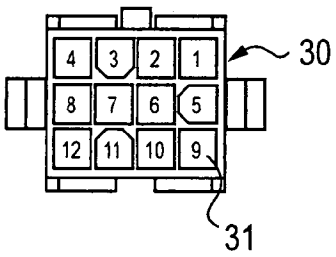
FIG. 10A is a front plan view of a universal connector positioned on the second end of the first adapter of the present invention.
Figure 10:
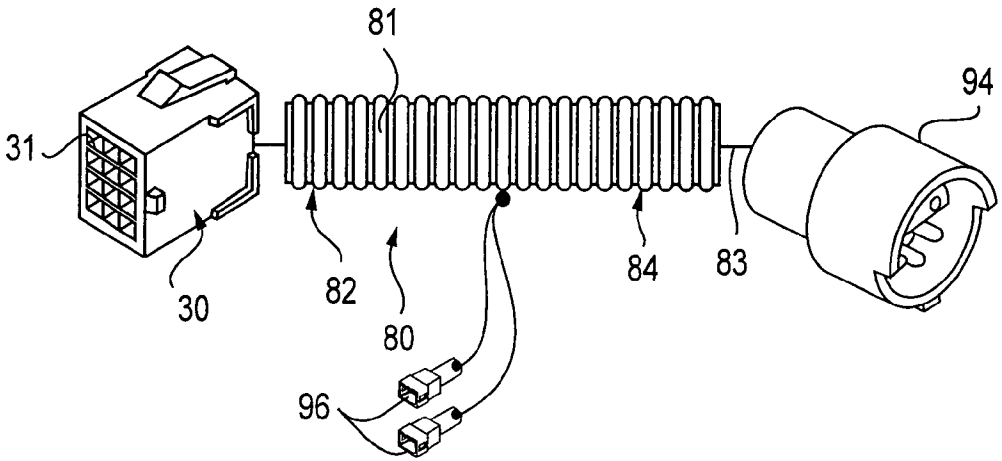
FIG. 10 is a schematic of an embodiment of a second adapter of the present invention.

FIG. 10 shows a second adapter 80 with a first end 82 and a second end 84. The second end 84 has a connector 94 configured to mate with a connector of a snowplow sold under the trademark HINIKER® (manufactured by Hiniker Company, Mankato, Minn.) (not shown). The second adapter 80 also has two female terminals 96 that are connectable to a switch (not shown) unique to snowplows sold under the trademark HINIKER®. FIG. 10B depicts a numbering configuration of the connector 64. FIG. 10A depicts a numbering configuration for the pins 31 of the universal connector 30 in order to mate the universal connector 30 with other connectors based on function. The pin assignments of both connector 30 and 94 are shown in Tables 20 and 21.

TABLE 20

| TYCO ® CONNECTOR P/N 172162-1 TYCO ® TERMINALS P/N 770903-1 | | |
|---|---|---|
| PIN # | COLOR | FUNCTION |
| 1 | RED | POS {+} |
| 2 | N/A | N/A |
| 3 | ORANGE | FLOAT |
| 4 | BROWN | PUMP SOLENOID |
| 5 | GREEN | RIGHT |
| 6 | BLUE | LEFT |
| 7 | N/A | N/A |
| 8 | N/A | N/A |
| 9 | N/A | N/A |
| 10 | N/A | N/A |
| 11 | N/A | N/A |
| 12 | BLACK | GROUND |
| | WHITE/BLACK | GROUND |

TABLE 21

| PEI-GENESIS SURE SEAL ® CONNECTIONS<br>CONNECTOR P/N 120-1874-000<br>FEMALE TERMINAL P/N 031-1067-001<br>MALE TERMINAL P/N 030-2196-001 | | |
|---|---|---|
| PIN # | COLOR | FUNCTION |
| 1 | BROWN | PUMP SOLENOID |
| 2 | ORANGE | FLOAT |
| 3 | RED | {POS +} |
| 4 | BLACK | GROUND |
| 5 | BLUE | LEFT |
| 6 | GREEN | RIGHT |
| 7 | WHITE/BLACK | SWITCH |

In one embodiment, individual wires 83 bundled within the length of tubing 81 are color coded to correspond to color coded receptacles in the connectors 86, 88, 90, 92, 94. The color coding of the individual wires 83 also corresponds to particular receptacles 31 of the universal connector 30.

Having shown a variety of examples of first adapters 20 and second adapters 80 , it is apparent that the present invention can be used to connect any controller to any snowplow. For example, if it were desired to use a 4-way small joystick harness with a snowplow sold under the trademarks of MEYER® or DIAMOND® (manufactured by Meyer Products, Inc., Cleveland, Ohio), a first adapter 20 of FIG. 5 would be used with a second adapter 80 of FIG. 6.

In operation, referring again to FIGS. 1–5 , the first adapter 20 is constructed based on the type of controller desired, whereby the individual pins 32, 42, 58 and 66; terminals 52 and 54; and/or female couplers 56, 64 and 74 on the first end 22 are connected to corresponding receptacles in the desired controller 40, 50, 62 and 72. The second end 24 is connected to the universal connector 28.

Referring now to FIGS. 6–10 , the second adapter 80 is constructed based on the desired snowplow, whereby the individual wires 83 on the second end 84 are connected to a particular snowplow connector 86, 88, 90, 92 and 94. The first end is connected to the universal connector 30 that corresponds to the universal connector 28 of the first adapter.

Referring now to FIG. 11, when the universal connector 28 of the first adapter 28 is mated with the universal connector 30 of the second adapter 28 the desired snowplow is connected to the desired controller. It is contemplated that features disclosed in this application can be mixed and matched to suit particular circumstances. For example, the wires 23 and 81 of any of the adapters 20 and 80 shown can be fitted to a particular connector to allow connection to a controller or snowplow not shown. Various other modifications and changes will be apparent to those of ordinary skill in the art without departing from the spirit and scope of the present invention. Accordingly, reference should be made to the claims to determine the scope of the present invention.

What is claimed is:

1. A universal control adapter system for functionally attaching a controller box to a snowplow wherein the controller box and the snowplow have incompatible connectors, the adapter system comprising:

a first adapter having a length of straight cord having a first end and a second end, wherein the first end has a plurality of pins for removably connecting the first end to a connector compatible with a controller box, and wherein the second end is connected to a first universal connector; and a second adapter having a length of tubing having a first end and a second end, wherein the first end is attached to a second universal connector, and wherein the second end has a plurality of pins which are removably attached to a connector configured to mate with a snowplow;

wherein the first universal connector on the second end of the first adapter is configured to mate with the second universal connector on the first end of the second adapter, thus allowing connection between previously incompatible controller boxes and snowplows.

2. The universal control adapter system of claim 1, wherein the controller box is a straight blade touchpad harness.

3. The universal control adapter system of claim 1, wherein the controller box is a vee-blade touchpad harness.

4. The universal control adapter system of claim 1, wherein the controller box is a main joystick harness.

5. The universal control adapter system of claim 1, wherein the controller box is an up/down joystick harness.

6. The universal control adapter system of claim 1, wherein the controller box is a 4-way joystick harness.

7. The universal control adapter system of claim 1, wherein the first universal connector on the second end of the first adapter is a male type connector and the second universal connector on the first end of the second adapter is a female type adapter.

8. The universal control adapter system of claim 7, wherein receptacles on the male type connectors are color coded to correspond to receptacles in the female type connector.

9. The universal control adapter system of claim 1, wherein the plurality of pins on the first end of the first adapter are attached to color coded wires that correspond to particular receptacles in the connector compatible with the controller box, and wherein the colors correspond to particular functions.

10. A method for connecting a universal control adapter system which allows for operative connection between a controller box and a snowplow which were not previously compatible, the method comprising:

providing a first adapter having a length of straight cord having a first end and a second end, wherein the first end has a plurality of pins;

removably connecting the plurality of pins of the first end to a connector compatible with a controller box;

connecting the second end of the first adapter to a first universal connector;

providing a second adapter having a length of tubing having a first end and a second end;

connecting the first end of the second adapter to a second universal connector;

removably attaching the second end of the second adapter to a connector configured to mate with a snowplow; and mating the first universal connector on the second end of the first adapter with the second universal connector on the first end of the second adapter.

11. The method of claim 10, wherein the controller box is a straight blade touchpad harness.

12. The method of claim 10, wherein the controller box is a vee-blade touchpad harness.

13. The method of claim 10, wherein the controller box is a main joystick harness.

14. The method of claim 10, wherein the controller box is an up/down joystick harness.

15. The method of claim 10, wherein the controller box is a 4-way joystick harness.

16. The method of claim 10, wherein the first universal connector on the second end of the first adapter is a male type connector and the second universal connector on the first end of the second adapter is a female type adapter.

17. The method of claim 16, further providing mating color coded receptacles on the male type connectors with corresponding color coded in the female type connector.

18. The method of claim 10, wherein the plurality of pins on the first end of the first adapter are attached to color coded wires that to correspond to similarly particular receptacles in the connector compatible with the controller box, and wherein the colors correspond to particular functions.

19. A universal control adapter means for connecting a snowplow to a controller comprising:

a first adapter means for removably connecting a controller connector means with a first universal connector means; and a second adapter means for removably connecting a second universal connector means with a snowplow connector means;

wherein the first universal connector means mates with the second universal connector means.

20. A universal control adapter system to achieve operative connection between an incompatible pairing of a desired controller box and a preferred snowplow, the universal control adapter kit comprising:

a selected control box side adapter chosen from a plurality of control box side adapters, wherein the plurality of control box side adapters have a first universal connector on a first end thereof and a plurality of different control box connectors on a second end thereof capable of connection with a plurality of control boxes, the selected control box side adapter chosen to fit with the desired controller box; and a selected plow side adapter chosen from a plurality of plow side adapters, wherein the plurality of plow side adapters have a second universal connector on a first end thereof and a plurality of different plow connectors on a second end thereof capable of connection with a plurality of plows, the selected plow side adapter chosen to fit with the preferred snowplow, wherein the first universal connector and the second universal connector are designed to be interconnectable with one another to form an operative connection between the desired controller box and the preferred snowplow.

21. The universal control adapter system of claim 20, wherein the desired controller box is a straight blade touchpad harness.

22. The universal control adapter system of claim 20, wherein the desired controller box is a vee-blade touchpad harness.

23. The universal control adapter system of claim 20, wherein the desired controller box is a main joystick harness.

24. The universal control adapter system of claim 20, wherein the desired controller box is an up/down joystick harness.

25. The universal control adapter system of claim 20, wherein the desired controller box is a 4-way joystick harness.

26. The universal control adapter system of claim 20, wherein the first universal connector on the second end of the selected control box side adapter is a male type connector and second universal connector on the first end of the selected plow side adapter is a female type adapter.

27. The universal control adapter system of claim 26, wherein receptacles on the male type connectors are color coded to correspond to receptacles in the female type connector.

* * * * *